US010039347B2

(12) United States Patent
Spanks

(10) Patent No.: US 10,039,347 B2
(45) Date of Patent: Aug. 7, 2018

(54) FASTENING MECHANISM FOR USE WITH A LACING ELEMENT

(71) Applicant: NIKE, Inc., Beaverton, OR (US)

(72) Inventor: Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 184 days.

(21) Appl. No.: 15/001,306

(22) Filed: Jan. 20, 2016

(65) Prior Publication Data

US 2017/0202313 A1 Jul. 20, 2017

(51) Int. Cl.
*A43C 7/00* (2006.01)
*A43C 11/14* (2006.01)

(52) U.S. Cl.
CPC ..... *A43C 11/14* (2013.01); *A43C 7/00* (2013.01)

(58) Field of Classification Search
CPC ..... A43C 11/14; A43C 11/12; A43C 7/00; A63B 33/002; Y10T 24/3705; Y10T 24/3947; Y10T 24/3953; Y10T 24/3956; Y10T 24/3969; Y10T 24/3703; Y10T 24/3716
See application file for complete search history.

(56) References Cited

U.S. PATENT DOCUMENTS 39,163 A 7/1863 Newton
657,606 A * 9/1900 Lee ..... A43C 7/04 24/712.2
2,551,723 A 5/1951 Camero
4,357,740 A 11/1982 Brown
4,790,048 A * 12/1988 Arnt ..... A43C 7/00 24/712.1
4,817,303 A 4/1989 Selbiger
5,097,573 A * 3/1992 Gimeno ..... A43C 7/00 24/712.2
5,117,567 A 6/1992 Berger
5,182,838 A 2/1993 Stenner
5,327,662 A 7/1994 Hallenbeck
5,894,639 A 4/1999 Boden
5,903,959 A 5/1999 Leonardi
6,185,798 B1 2/2001 Ton
6,189,186 B1 2/2001 Boden
(Continued)

FOREIGN PATENT DOCUMENTS

EP 0719958 A3 * 9/1996 ..... A43C 7/00
FR 403840 A 6/1909
(Continued)

OTHER PUBLICATIONS

Mar. 22, 2017—(WO) ISR and Written Opinion—App. No. PCT/US2017/014295.

*Primary Examiner* — Robert Sandy
*Assistant Examiner* — Matthew J Sullivan
(74) *Attorney, Agent, or Firm* — Banner & Witcoff, Ltd.

(57) ABSTRACT

A fastening mechanism for use with a lacing element is disclosed. The fastening mechanism is adjustable and includes an elongated member and a rigid element. There are two channels extending through the fastening mechanism that are configured to receive and secure portions of the lacing element. In some embodiments, a plurality of ridges can be formed along a sloped sidewall in each of the channels. The fastening mechanism may be utilized with articles of footwear or apparel.

20 Claims, 6 Drawing Sheets

(56) References Cited

U.S. PATENT DOCUMENTS

| | | | | |
|---|---|---|---|---|
| 7,124,482 | B2 * | 10/2006 | Kim | A43C 7/00 24/115 R |
| 7,428,789 | B2 | 9/2008 | Holzer | |
| 7,574,818 | B2 | 8/2009 | Meschter | |
| 7,631,440 | B2 | 12/2009 | Keen | |
| 8,141,273 | B2 | 3/2012 | Stramare | |
| 8,266,827 | B2 | 9/2012 | Dojan | |
| 9,113,674 | B2 | 8/2015 | Dojan | |
| 2004/0250388 | A1 | 12/2004 | Martin | |
| 2011/0016680 | A1 | 1/2011 | Chang | |
| 2012/0240428 | A1 | 9/2012 | Knoll | |
| 2014/0137432 | A1 | 5/2014 | Eldem | |
| 2015/0089839 | A1 | 4/2015 | James | |
| 2016/0037846 | A1 * | 2/2016 | Lombardi, Jr. | A41F 19/00 24/115 G |

FOREIGN PATENT DOCUMENTS

| | | | | |
|---|---|---|---|---|
| FR | 2902982 | A1 | 7/2006 | |
| WO | WO-9847401 | A1 * | 10/1998 | A43C 7/00 |
| WO | 2004095968 | A1 | 11/2004 | |

* cited by examiner

FASTENING MECHANISM FOR USE WITH A LACING ELEMENT

BACKGROUND

The present embodiments relate generally to fastening mechanisms, and in particular to fastening mechanisms for use with lacing elements such as lacing elements in articles of footwear.

Fastening mechanisms can be used to facilitate the tensioning or loosening of articles of footwear. An article of footwear generally includes two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the upper often incorporates a lacing element that is routed over various portions of the upper.

SUMMARY

In one aspect, the present disclosure is directed to a fastening mechanism for an article of footwear, comprising a rigid element attached to an elongated member, the elongated member including a central aperture that is sized and dimensioned to receive the rigid element, the elongated member being substantially more flexible than the rigid element. In addition, a first channel is formed between the rigid element and the elongated member and a second channel formed between the rigid element and the elongated member. The first channel is configured to receive at least a portion of a lacing element. The first channel includes a sloped sidewall comprising an upper sloped sidewall portion and a lower sloped sidewall portion that is continuous with the upper sloped sidewall portion. Furthermore, the first channel includes a proximal channel portion, the proximal channel portion comprising the lower sloped sidewall portion and an inner wall portion disposed opposite of the lower sloped sidewall portion, where the lower sloped sidewall portion is sloped relative to the inner wall portion. The first channel also includes a distal channel portion, the distal channel portion comprising the upper sloped sidewall portion and an outer edge portion disposed opposite to the upper sloped sidewall portion, wherein the upper sloped sidewall portion extends between the lower sloped sidewall portion and the distal opening. In addition, the sloped sidewall including a plurality of ridges.

In another aspect, the present disclosure is directed to a fastening mechanism for an article of footwear, comprising a thickness extending between a distal surface and a proximal surface of the fastening mechanism, a rigid element and an elongated member, the rigid element being located in a central aperture of the elongated member. The fastening mechanism also includes a first channel formed between the rigid element and the elongated member, where the first channel extends through the thickness of the fastening mechanism between a distal opening formed in the distal surface and a proximal opening formed in the proximal surface. The first channel is configured to receive at least a portion of a lacing element. Furthermore, the first channel comprises an outer edge portion, an inner wall portion, a rigid sidewall, and a sloped sidewall, the inner wall portion being disposed opposite to the sloped sidewall. The sloped sidewall includes a plurality of ridges, where each of the plurality of ridges comprise a first edge joined to a second edge, the first edge being orthogonal to the second edge. The elongated member includes a first state and a second state, and the first edge is substantially parallel with the vertical axis in the first state, while the first edge is oriented diagonally with respect to the vertical axis in the second state. In addition, the fastening mechanism is configured to transition from the first state to the second state when a compressive force is applied to a first member end of the elongated member and a second member end of the elongated member.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale; emphasis is instead being placed upon illustrating the principles of the embodiments. Moreover, in the figures, like reference numerals designate corresponding parts throughout the different views.

DETAILED DESCRIPTION

Figure 1:
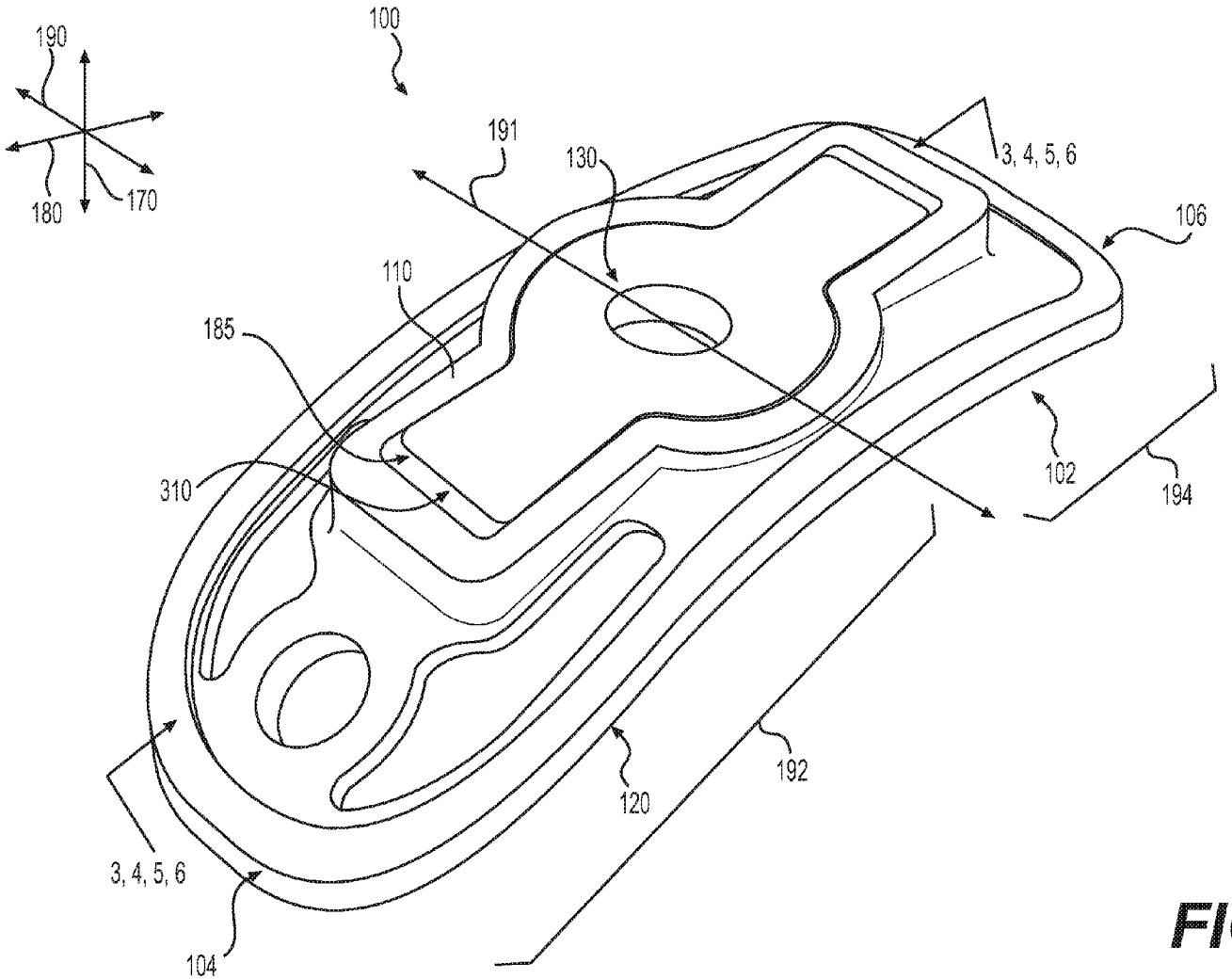
FIG. 1 is an isometric view of an embodiment of a fastening mechanism.
Figure 2:
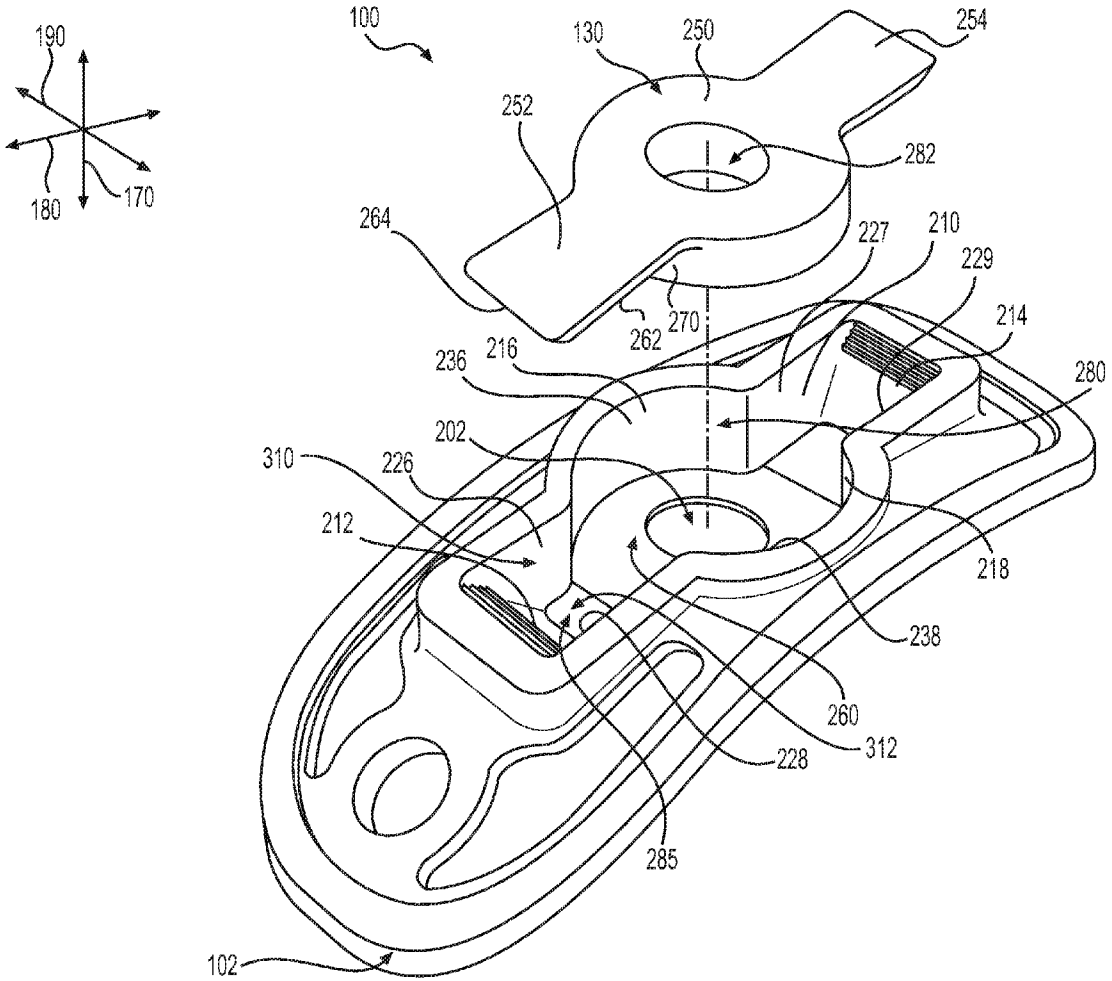
FIG. 2 is an isometric exploded view of an embodiment of a fastening mechanism.

FIGS. 1-2 depict isometric views of an embodiment of a fastening mechanism 100. In one embodiment, the provisions discussed herein for fastening mechanisms could be incorporated into various kinds of articles of footwear including, but not limited to, basketball shoes, hiking boots, soccer shoes, football shoes, tennis shoes, climbing shoes, sneakers, running shoes, cross-training shoes, rugby shoes, rowing shoes, baseball shoes as well as other kinds of shoes. Moreover, in some embodiments, the provisions discussed herein for fastening mechanisms could be incorporated into various other kinds of non-sports-related footwear, including, but not limited to, slippers, sandals, high-heeled footwear, and loafers. In other embodiments, fastening mechanism 100 could be used with articles or apparel or any other devices that include a tensioning or lacing component.

FIGS. 1-2 illustrate various features and components of fastening mechanism 100, including an elongated member 102 and a rigid element 130. FIG. 1 provides an isometric assembled view of an embodiment of fastening mechanism 100. FIG. 2 provides an isometric exploded view of an embodiment of fastening mechanism 100. As shown in the Figures, elongated member 102 has a substantially elongated body, with a length extending between a first member end 104 and a second member end 106 along a direction substantially aligned with a longitudinal axis 180. Furthermore, it can be seen that in some embodiments, elongated member 102 includes a curvature. In other words, in some embodiments, portions of distal surface 110 can have a substantially convex shape. In another embodiment, proximal surface 120 can have a substantially concave shape. In some embodiments, the curvature of elongated member 102 can correspond to a portion of an upper for an article of footwear and/or facilitate the positioning of fastening mechanism 100 along an upper. In another embodiment, the curvature of elongated member 102 can facilitate the bending of fastening mechanism 100 by a user during use of fastening mechanism 100.

In the exploded view of FIG. 2, it can be seen that elongated member 102 includes a central chamber 280. In one embodiment, rigid element 130 can be located in central chamber 280 of the elongated member. In some embodiments, central chamber 280 can be sized and dimensioned to snugly receive rigid element 130. However, in other embodiments, central chamber 280 can vary in size and shape, such that a larger space or gap remains between rigid element 130 and an inner surface 210 of elongated member 102 after rigid element 130 is received by central chamber 280 than depicted.

For purposes of reference, inner surface 210 surrounding central chamber 280 can comprise various portions. In FIG. 2, inner surface 210 of elongated member 102 has a first sloped sidewall 212 and a second sloped sidewall 214, as well as an upwardly facing surface associated with a base portion 260 of elongated member 102. In addition, a first side portion 216 and a second side portion 218 extend between distal surface 110 and proximal surface 120 in a direction substantially aligned with a vertical axis 170. First side portion 216 is disposed opposite to—or facing—second side portion 218. Furthermore, first side portion 216 comprises a first sidewall 226 and a second sidewall 227, and second side portion 218 comprises a third side panel 228 and a fourth side panel 229. It can be seen that first sidewall 226 and third side panel 228 are formed along opposite sides of inner surface 210 (i.e., first sidewall 226 and third side panel 228 face one another). Similarly, second sidewall 227 and fourth side panel 229 are formed along opposite sides of inner surface 210 (i.e., second sidewall 227 and fourth side panel 229 face one another). Furthermore, in some embodiments, first sidewall 226 and third side panel 228 are substantially similar in size and shape, and second sidewall 227 and fourth side panel 229 are substantially similar in size and shape. First sidewall 226 and second sidewall 227 are bridged together by a first curved portion 236, and third side panel 228 and fourth side panel 229 are joined together by a second curved portion 238.

In different embodiments, rigid element 130 can be disposed within central chamber 280. In some embodiments, rigid element 130 is attached to elongated member 102. In one embodiment, rigid element 130 is fixedly attached to elongated member 102. For purposes of this description, "fixedly attached" refers to an attachment between portions of different elements or materials where the portions are intended to remain attached during use of the component. In some embodiments, this may also be referred to as permanently attached. Fixedly attached may be contrasted with components that are removable. The fixed attachment may be formed through sewing, stitching, fusioning, bonding, gluing (by an adhesive or other agents), compressing, or a combination of thereof. In some embodiments, inner surface 210 may include provisions that strengthen or facilitate the attachment of rigid elements 130 with elongated member 102. In some other embodiments, elongated member 102 and rigid element 130 may be integrally attached.

It should be understood that in some embodiments, different portions of elongated member 102 and/or rigid element 130 could be symmetric with respect to one another. For purposes of this description, the term "symmetric" is used to characterize a component that has symmetry about some common axis. For example, referring to FIG. 1, fastening mechanism 100 may be divided along midline 191 parallel to a lateral axis 190, and comprise a first side 192 and a second side 194. In some embodiments, first side 192 may be symmetric with respect to second side 194. In other words, first side 192 of fastening mechanism 100 can be substantially similar to second side 194 of fastening mechanism 100 in some embodiments. In one embodiment, a symmetric configuration of fastening mechanism denotes that each of the first side and the second side of the fastening mechanism is an approximate mirror image of the other. However, in other embodiments (not depicted here), there may be differences in the size, shape, and/or positions of various portions of the components such that the two sides are asymmetric.

For purposes of reference, rigid element 130 can comprise various portions. In FIG. 2, rigid element 130 has a first wing portion 252 joined to a central portion 250 along first side 292. Similarly, a second wing portion 254 is joined to central portion 250 along second side 194. In some embodiments, first wing portion 252 and second wing portion 254 can be substantially similar. In one embodiment, first wing portion 252 and second wing portion 254 are approximately mirror images of one another. Thus, although only first wing portion 252 will be discussed in detail in the following description, it should be understood that details provided herein regarding first wing portion 252 may be applicable to second wing portion 254.

In some embodiments, elongated member 102 can include provisions for supporting rigid element 130 and/or for fixed attachment to rigid element 130. In some embodiments, portions of central portion 250 of rigid element 130 can be disposed adjacent to (or in direct contact) with base portion 260 of elongated member 102. In one embodiment, some portions of central portion 250 and some portions of base portion 260 can be fixedly attached to one another. In one embodiment, base portion 260 can include provisions for snugly receiving central portion 250 and helping to secure rigid element 130 to elongated member 102.

Base portion 260 can vary widely in size, shape, and thickness in different embodiments. In some embodiments, base portion 260 can be substantially flat and/or continuous. In other embodiments, base portion 260 can include texturing, fasteners, discontinuities, or apertures, for example. Some embodiments may not include base portion 260, or base portion 260 may be substantially small in dimension relative to the rest of fastening mechanism 100. In one embodiment, base portion 260 is substantially thin or narrow relative to central portion 250. In some embodiments, fastening mechanism 100 can include provisions for decreasing the weight of fastening mechanism 100 and/or provide a pleasing aesthetic design. As shown in FIG. 2, base portion 260 includes a first central aperture 202 that can be substantially aligned with a second central aperture 282 of rigid element 130 to form a continuous, through-hole aperture (see the cross section of FIG. 3) in fastening mechanism 100.

For purposes of clarity, the following detailed description discusses the features of fastening mechanism 100. The embodiments may be characterized by various directional adjectives and reference portions. These directions and reference portions may facilitate in describing the portions of a fastening mechanism. Moreover, these directions and reference portions may also be used in describing subcomponents of a fastening mechanism.

For consistency and convenience, directional adjectives are employed throughout this detailed description corresponding to the illustrated embodiments. The term "longitudinal" as used throughout this detailed description and in the claims refers to a direction or axis extending a length of a component. In FIGS. 1 and 2, longitudinal axis 180 is oriented along a direction extending between first member end 104 to second member end 106 of fastening mechanism 100. Also, the term "lateral" as used throughout this detailed description and in the claims refers to a direction or axis extending along a width of a component (see lateral axis 190 described below). Furthermore, the term "vertical" as used throughout this detailed description and in the claims refers to a direction or axis generally perpendicular to a lateral and longitudinal direction.

Additionally, the term "inner" or "proximal" refers to a portion of the mechanism that would be disposed closer to an interior of an article of footwear, or closer to a foot when the fastening mechanism is incorporated into an article of footwear. Likewise, the term "outer" or "distal" refers to a portion of the mechanism that would be disposed further from the interior of the article of footwear or from the foot when the fastening mechanism is positioned on an upper. Thus, for example, the proximal surface of a component is disposed closer to or is placed in contact with the surface of an article of footwear than the distal surface of the component.

As shown in FIG. 2, for purposes of reference, first wing portion 252 includes a rigid sidewall 262 (see the cross section of FIG. 3) and an outer edge portion 264. Rigid sidewall 262 extends between central portion 250 on first side 192 in an outward direction substantially aligned with longitudinal axis 180. Outer edge portion 264 can comprise a narrow peripheral edge portion of rigid element 130 that extends between distal surface 110 and rigid sidewall 262 in some embodiments. It can further be noted that in some embodiments, the thickness of first wing portion 252 is substantially less than the thickness associated with central portion 250. Each of rigid sidewall 262 and outer edge portion 264 can be substantially planar or flat in some embodiments, though in other embodiments, any of the sidewalls or surfaces of a channel may include texturing or some curvature. Furthermore, central portion 250 comprises an inner wall portion 270 associated with first side 192. Inner wall portion 270 may include a curvature associated with the round shape of central portion 250. Inner wall portion 270 will be discussed further with respect to FIGS. 3 and 4.

The various portions of elongated member 102 may be formed from different materials. In some embodiments, elongated member 102 may include a flexible, compressible, deformable, and/or resilient material. In different embodiments, elongated member 102 can be formed from synthetic rubbers, natural rubbers, flexible plastics, polymers, elastomers, siloxanes, or other flexible materials. Furthermore, in different embodiments, the various portions of rigid element 130 may be formed from a variety of materials. In some embodiments, as shown herein, rigid element 130 may be formed from a material that is stiffer or more rigid relative to the material(s) of elongated member 102. In other words, in some embodiments, elongated member 102 is more flexible than rigid element 130.

Furthermore, various portions of fastening mechanism 100, such as an outermost-facing distal surface 110 or an outermost-facing proximal surface 120, can be formed from a wear-resistant and/or water-resistant material. In addition, in some embodiments, portions of fastening mechanism 100 can be textured to impart traction for facilitating grip by a user or with a lacing element.

It should be understood that the following figures are for purposes of illustration only, and each of the components described above with respect to FIGS. 1-2 may be included or referred to in the description while not illustrated in the figures.

Figure 3:
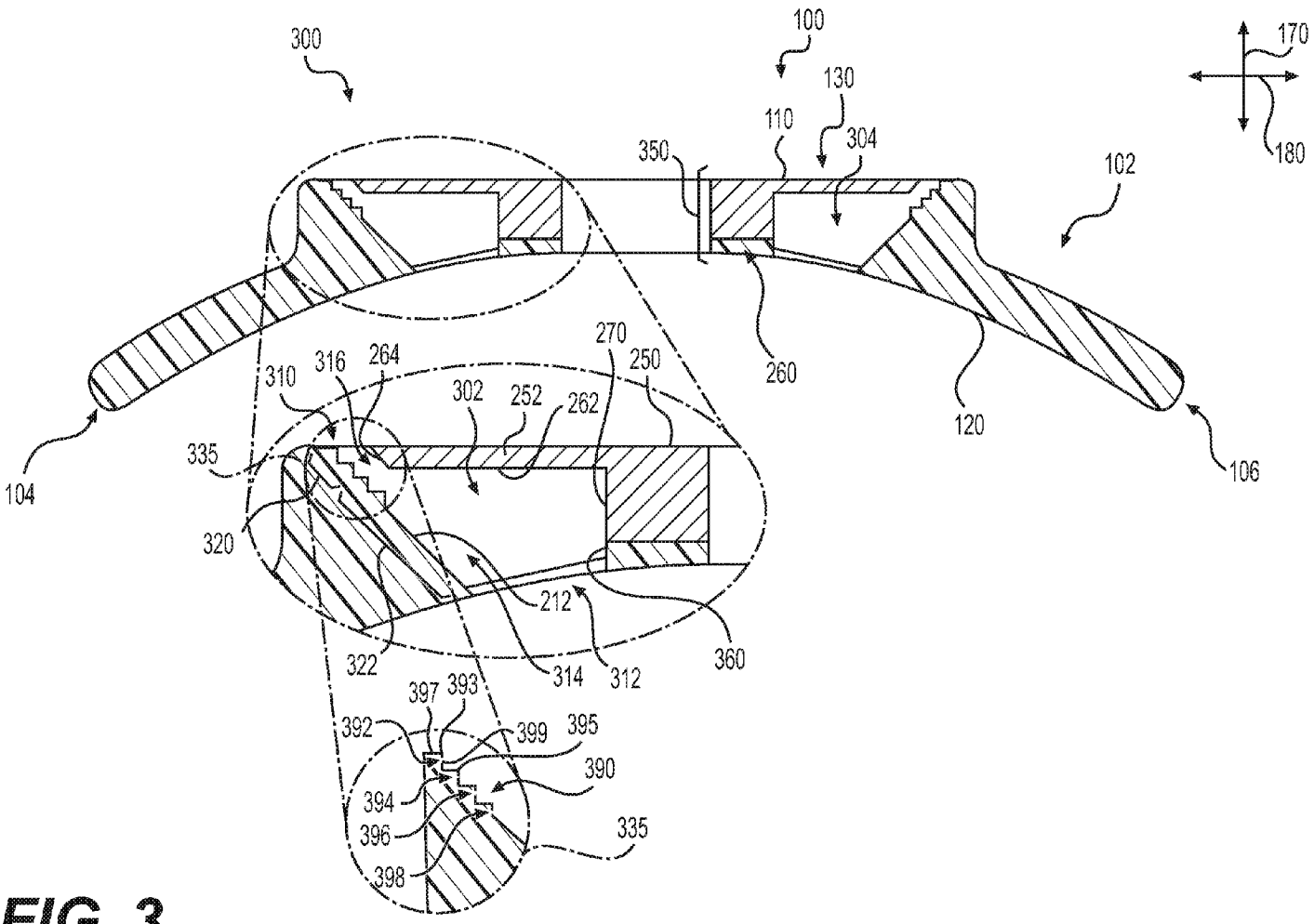
FIG. 3 is a cross-sectional schematic view of an embodiment of a fastening mechanism in a first state.
Figure 4:
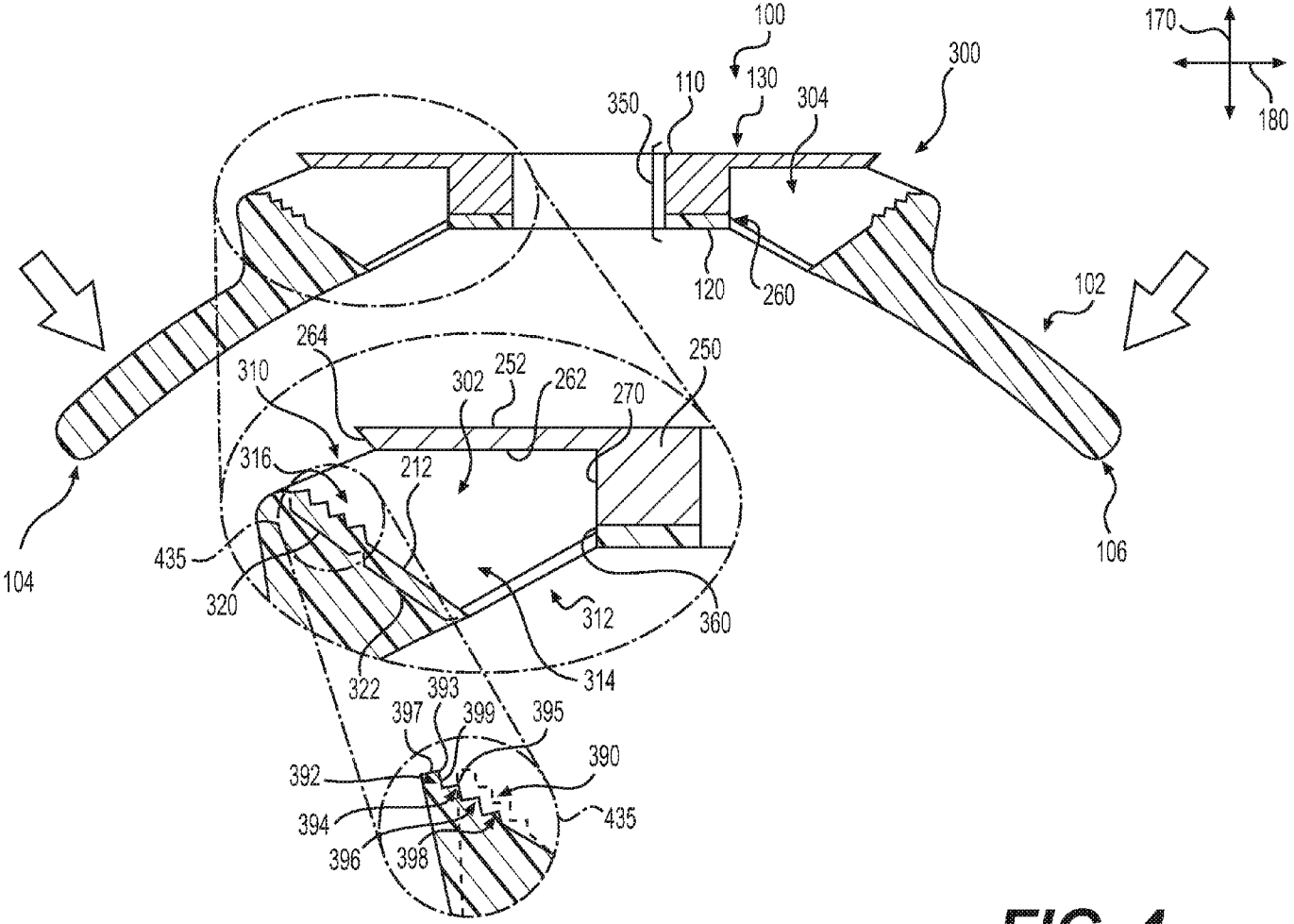
FIG. 4 is a cross-sectional schematic view of an embodiment of a fastening mechanism in a second state.

In order to provide a better understanding of some of the embodiments to the reader, FIGS. 3-4 provide a series of cross-sectional views of fastening mechanism 100. As noted above, in some embodiments, fastening mechanism 100 can include provisions for helping to secure or fasten and/or loosen a lacing element. Referring to FIGS. 3 and 4, in some embodiments, fastening mechanism 100 can include a first state (represented in FIG. 3) and a second state (represented in FIG. 4). FIG. 3 is associated with the normal or resting configuration of fastening mechanism 100 where, for example, a lacing element is contracted, compressed, pinched, secured, held, gripped, closed, or tightened. The first state can also be associated with a fastening mechanism that does not include any lacing element. FIG. 4 is associated with the deformed configuration (second state) of fastening mechanism 100 where, for example, a lacing element can be loosened, unsecured and/or readily inserted or removed from fastening mechanism 100. Generally, for purposes of this disclosure, the second state represents the application of an external force (such as a compressive force) along portions of elongated member 102, while the first state represents the configuration of fastening mechanism 100 in which no external forces are being applied to elongated member 102.

In FIGS. 3 and 4, it can be seen that fastening mechanism 100 includes two channels 300. Channels 300 can be configured to receive at least a portion of a lacing element in different embodiments. A first channel 302 is formed through the thickness of fastening mechanism 100 along first side 192, and a second channel 304 is formed through the thickness of fastening mechanism 100 along second side 194. For purposes of the description and the claims, it should be understood that first channel 302 and second channel 304 are substantially similar. In other words, in some embodiments, the features, dimensions, shape, and/or configurations described with respect to first channel 302 may be applicable to second channel 304. In one embodiment, first channel 302 and second channel 304 are approximately mirror images of one another. Thus, while only first channel 302 will be discussed in detail in the following description, it should be understood that details provided herein regarding first channel 302 may be applicable to second channel 304.

As shown in FIG. 3, first channel 302 is an opening that extends through a thickness 350 of fastening mechanism 100 between a proximal opening 312 formed in proximal surface 120 of fastening mechanism 100 and a distal opening 310 formed in an distal surface 110 of fastening mechanism 100. In different embodiments, the shape of each opening can vary. For example, proximal opening 312 and/or distal opening 310 can comprise a round, square, rectangular, polygonal, or other regular or irregular shape. In the present embodiment, proximal opening 312 is substantially rectangular (as generally depicted in the exploded view of FIG. 2), and distal opening 310 is substantially rectangular (as generally depicted in the assembled view of FIG. 1). Furthermore, in some embodiments, it can be understood that a first cross-sectional area 285 (see FIG. 2) of proximal opening 312 is larger than a second cross-sectional area 185 (see FIG. 1) of distal opening 310. In one embodiment, distal opening 310 is substantially narrow and may comprise a small slit in the first state, the slit being partly bordered by outer edge portion 264 of rigid element 130 and a portion of upper sloped sidewall 320.

For purposes of reference, first channel 302 may be understood to comprise a proximal channel portion ("proximal portion") 314 that is in fluid communication with a distal channel portion ("distal portion") 316. Proximal portion 314 is in fluid communication with proximal opening 312, and distal portion 316 is in fluid communication with distal opening 310. It should be understood that the identification of proximal portion 314 and distal portion 316 are for purposes of reference only and are not intended to demarcate precise regions of the channel.

In some embodiments, proximal portion 314 of first channel 302 comprises or is otherwise surrounded by a first plurality of sidewalls, and distal portion 316 of first channel 302 comprises or is otherwise surrounded by a second plurality of sidewalls. In one embodiment, the first plurality of sidewalls that help define the bounds of proximal portion 314 can include rigid sidewall 262, inner wall portion 270, and a portion of first sloped sidewall 212, herein referred to as a lower sloped sidewall 322. In some embodiments, proximal portion 314 can also include a base sidewall 360 associated with a side of base portion 260. In FIG. 3, base sidewall 360 is substantially aligned with inner wall portion 270 (i.e., base sidewall 360 forms a substantially continuous, flat surface with inner wall portion 270). In one embodiment, base sidewall 360 extends in a direction substantially aligned with vertical axis 170. As shown in FIG. 3, inner wall portion 270 is disposed opposite to lower sloped sidewall 322. Furthermore, in some embodiments, lower sloped sidewall 322 is sloped relative to inner wall portion 270. In some cases, lower sloped sidewall 322 is nonparallel with respect to inner wall portion 270. In other words, while inner wall portion 270 extends in a direction substantially aligned with vertical axis 170, lower sloped sidewall 322 is oriented in a direction that is substantially diagonal with respect to vertical axis 170. In some embodiments, lower sloped sidewall 322 may be understood to extend outward from a center or middle region of fastening mechanism 100 toward an outer end of fastening mechanism 100.

As noted above, in different embodiments, distal portion 316 comprises a second plurality of sidewalls. The second plurality of sidewalls that help define the bounds of proximal portion 314 can include outer edge portion 264, and a portion of first sloped sidewall 212, herein referred to as an upper sloped sidewall 320. In other words, lower sloped sidewall 322 extends between upper sloped sidewall 320 and proximal opening 312 and, similarly, upper sloped sidewall 320 extends between lower sloped sidewall 322 and distal opening 310.

As shown in FIG. 3, outer edge portion 264 is disposed opposite to upper sloped sidewall 320. Furthermore, in some embodiments, upper sloped sidewall 320 is sloped relative to outer edge portion 264. In some cases, upper sloped sidewall 320 is nonparallel with respect to outer edge portion 264. In other words, in some embodiments, while outer edge portion 264 extends in a direction substantially aligned with vertical axis 170, upper sloped sidewall 320 is oriented in a direction that is substantially diagonal with respect to vertical axis 170. In some embodiments, upper sloped sidewall 320 may be understood to extend outward from a center or middle region of fastening mechanism 100 toward an outer end of fastening mechanism 100.

In different embodiments, first sloped sidewall 212 can include a generally flat surface. However, in other embodiments, first sloped sidewall 212 can include a plurality of ridges 390, as shown in a magnified view 335 in FIG. 3 and a magnified view 435 in FIG. 4. In FIGS. 3 and 4, first sloped sidewall 212 has a first ridge 392, a second ridge 394, a third ridge 396, and a fourth ridge 398. Each ridge is directly adjacent to the neighboring ridge in FIGS. 3 and 4. In other words, plurality of ridges 390 can be substantially continuous in some embodiments, such that there is no space or gap between neighboring ridges. However, in other embodiments, a first ridge may be spaced apart from a second ridge, for example. In some embodiments, there can be additional ridges (i.e., five or more ridges) in plurality of ridges 390. In other embodiments, there may be fewer than four ridges. In the embodiment of FIGS. 3 and 4, first sloped sidewall 212 continues toward proximal opening 312 in a substantially flat manner below fourth ridge 398.

For purposes of this disclosure, the use of the term "ridges" refers to undulations, teeth, ridges, steps, or other raised or edged elements formed along a surface. In the present embodiments, plurality of ridges 390 present a series of regularly repeating and uniform ridges. However, in other embodiments, two or more ridges may differ in size, shape, and/or curvature. In different embodiments, plurality of ridges 390 can increase friction with a lacing element and/or facilitate the grip or securing of a lacing element within fastening mechanism 100.

In FIGS. 3 and 4, each ridge includes a tip portion. For example, first ridge 392 has a first tip portion 393 and second ridge 394 has a second tip portion 395. In some embodiments, each of first tip portion 393 and second tip portion 395 include an approximately right-angled corner. In other words, one or more (or all) of the ridges formed along first sloped sidewall 212 can comprise a chevron-type pattern, with substantially 90-degree corner portions. Thus, in one embodiment, a first edge 397 of first ridge 392 and a second edge 399 of first ridge 392 are approximately orthogonal with respect to one another.

Furthermore, the location of plurality of ridges 390 may vary in some embodiments. In some embodiments, plurality of ridges 390 can be arranged nearer proximal opening 312, nearer distal opening 310, or generally are formed between proximal opening 312 and distal opening 310. In FIG. 3, plurality of ridges 390 are nearer to distal opening 310 than they are to proximal opening 312.

In addition to the first plurality of sidewalls and the second plurality of sidewalls described above as circumscribing proximal portion 314 and distal portion 316 of first channel 302, additional wall portions can bound portions of a channel. As shown in FIGS. 1 and 2, elongated member 102 includes first sidewall 226 and a second sidewall 227. Though not depicted in the cross sections of FIGS. 3-6, each of first sidewall 226 and second sidewall 227 can be understood to bound or substantially enclose first channel 302 along opposite sides. Furthermore, as a result of each of the boundaries provided by each of rigid sidewall 262, inner wall portion 270, and lower sloped sidewall 322, as well as first sidewall 226 and second sidewall 227, proximal portion 314 of first channel 302 can be understood to comprise a substantially trapezoidal prism shape in some embodiments. In some embodiments, first channel 302 can have an approximately rectangular cross-sectional shape in a horizontal plane in cases where inner wall portion 270 is relatively flat.

As noted above, in order to better understand the operation of fastening mechanism 100, FIGS. 3 and 4 represent different states or configurations of fastening mechanism 100. In FIG. 3, elongated member 102 is in the first state, and in FIG. 4, elongated member 102 is in the second state. As shown in FIG. 3, first edge 397 extends in a direction that is substantially aligned with vertical axis 170 in the first state. When a force (represented by two arrows) is applied along or near first member end 104 and second member end 106 as shown in FIG. 4, there can be a compression of elongated member 102 in an inward direction. In some embodiments, portions of elongated member 102 can elastically deform. However, it can also be seen that in some embodiments, rigid element 130 may remain undeformed or substantially unchanged during the transitions from the first state to the second state, and/or transitions from the second state to the first state. In other words, in some embodiments, while elongated member 102 can change shape and/or position during operation of fastening mechanism 100, the configuration of rigid element 130 in the first state is substantially similar to the configuration of rigid element 130 in the second state.

When elongated member 102 transitions to the second state (as shown in FIG. 4), it can be seen that first edge 397 extends in a direction that is oriented diagonally with respect to vertical axis 170. In other words, as fastening mechanism 100 is compressed, the orientation of the two sloped sidewalls (i.e., first sloped sidewall 212 and second sloped sidewall 214) as well as plurality of ridges 390 that are formed on each of the sloped sidewalls can change in different embodiments. In some embodiments, for example, first tip portion 393 and second tip portion 395 can change orientation and move in a generally clockwise direction as fastening mechanism 100 transitions from the first state to the second state. This can facilitate the loosening of a lace element from the channels in some embodiments.

Furthermore, in the second state, the entryway of distal opening 310 can become enlarged in some embodiments. As shown in FIG. 3, distal opening 310 has a first size. In FIG. 4, distal opening 310 has a second size. In different embodiments, the second size is substantially larger than the first size. In other embodiments, distal opening 310 may be nearly closed and inaccessible in the first state, and form an opening of increasing size as fastening mechanism 100 transitions toward the second state. In some embodiments, the overall volume of each channel can increase in the second state relative to the first state in some cases. This increase in size can facilitate the passage of a lace element through the channels of fastening mechanism 100 in some embodiments, for example by more readily accommodating the girth of any lace portions.

In addition, it should be understood that when the compressive force is removed, fastening mechanism 100 can return to the first state. However, the first state can differ in some cases from that depicted in FIG. 3. For example, when a lace portion is inserted into a channel during the second state and the compressive force is removed, first member end 104 and second member end 106 can elastically transition back toward their original positions. However, due to the thickness or size of any lacing portion disposed within the channel(s), the various portions of elongated member 102 may be blocked from returning entirely to the position shown in FIG. 3 for the first state, and there may be some expansion in the volume of a channel even in the first state. Thus, in some cases, the first state is configured to help secure a lacing element, while the second state is configured to help release a lacing element.

As noted above, in different embodiments, fastening mechanism 100 may be configured for use with a lacing element. In some embodiments, a lacing element—also referred to herein as tensile elements—can extend through the various openings and channels of fastening mechanism 100. In one embodiment, fastening mechanism 100 can be used with an article of footwear and permit a user to modify dimensions of an upper to accommodate the proportions of a foot. More particularly, a tensile element used in conjunction with fastening mechanism 100 may permit the wearer to tighten portions of the upper around the foot, and/or fastening mechanism 100 can permit the wearer to loosen an upper to facilitate entry and removal of the foot from the article of footwear.

For purposes of this disclosure, lacing or tensile elements may be formed from any generally one-dimensional material. As utilized with respect to the present invention, the term "one-dimensional material" or variants thereof is intended to encompass generally elongated materials exhibiting lengths that are substantially greater than their width and thickness. Accordingly, suitable materials for tensile elements include various filaments, fibers, yarns, threads, cables, laces (i.e., lacing elements), or ropes that are formed from rayon, nylon, polyester, polyacrylic, silk, cotton, carbon, glass, aramids (e.g., para-aramid fibers and meta-aramid fibers), ultra-high molecular weight polyethylene, liquid crystal polymer, copper, aluminum, and steel. Whereas filaments have an indefinite length and may be utilized individually as tensile elements, fibers have a relatively short length and generally go through spinning or twisting processes to produce a strand of suitable length. An individual filament utilized in the tensile element, guide elements, and/or reinforcing elements may be formed from a single material (i.e., a monocomponent filament) or from multiple materials (i.e., a bicomponent filament). Similarly, different filaments may be formed from different materials. As an example, yarns utilized as tensile elements may include filaments that are each formed from a common material, may include filaments that are each formed from two or more different materials, or may include filaments that are each formed from two or more different materials. Similar concepts also apply to threads, cables, or ropes. The thickness of tensile elements may also vary significantly to range from 0.03 millimeters to more than 15 millimeters, for example. Although one-dimensional materials will often have a cross section where width and thickness are substantially equal (e.g., a round or square cross section), some one-dimensional materials may have a width that is greater than a thickness (e.g., a rectangular, oval, or otherwise elongate cross section). Despite the greater width, a material may be considered one-dimensional if a length of the material is substantially greater than a width and a thickness of the material. In some embodiments, the tensile elements utilized with fastening mechanism 100 can comprise materials, features, or elements disclosed in Dojan, U.S. Pat. No. 9,113,674, issued on Aug. 25, 2015 (previously U.S. patent application Ser. No. 13/327,229, filed Dec. 15, 2011) and entitled "Footwear Having An Upper With Forefoot Tensile Strand Elements," Dojan et al., U.S. Pat. No. 8,266,827, issued on Sep. 18, 2012 (previously U.S. patent application Ser. No. 12/546,022) and entitled "Article Of Footwear Incorporating Tensile Strands and Securing Strands," and Meschter, U.S. Pat. No. 7,574,818, issued on Aug. 18, 2009 (previously U.S. patent application Ser. No. 11/442,669, filed on May 25, 2006) and entitled "Article Of Footwear Having An Upper With Thread Structural Elements," the disclosures of which are incorporated herein by reference in their entirety.

Figure 5:
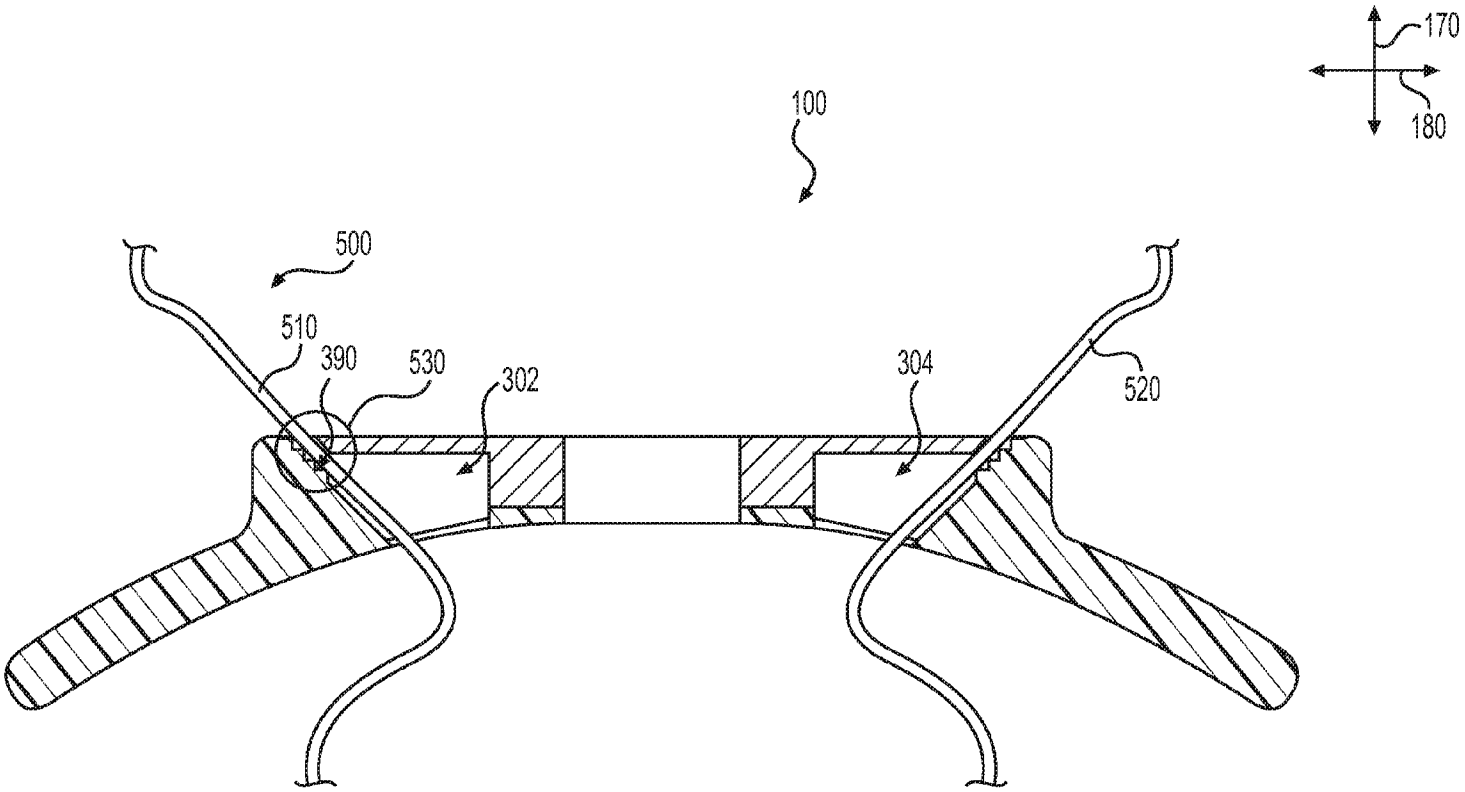
FIG. 5 is a cross-sectional schematic view of an embodiment of a fastening mechanism with a lacing element.

Referring now to FIG. 5, a cross-sectional view of fastening mechanism 100 is shown with a first lacing element 500. First lacing element 500 includes a first portion 510 extending through first channel 302, and a second portion 520 extending through second channel 304. It can be seen that first portion 510 has a first secured region 530, where first secured region 530 refers to the segment(s) of first portion 510 that is held or gripped by portions associated with first channel 302. In other embodiments, first secured region 530 is associated with the portion of the lacing element that is contacted, pinched, or compressed by one or more of plurality of ridges 390. In FIG. 5, due to the girth of first lacing element 500, distal opening 310 has a third size in the secured or resting (first) state.

Figure 6:
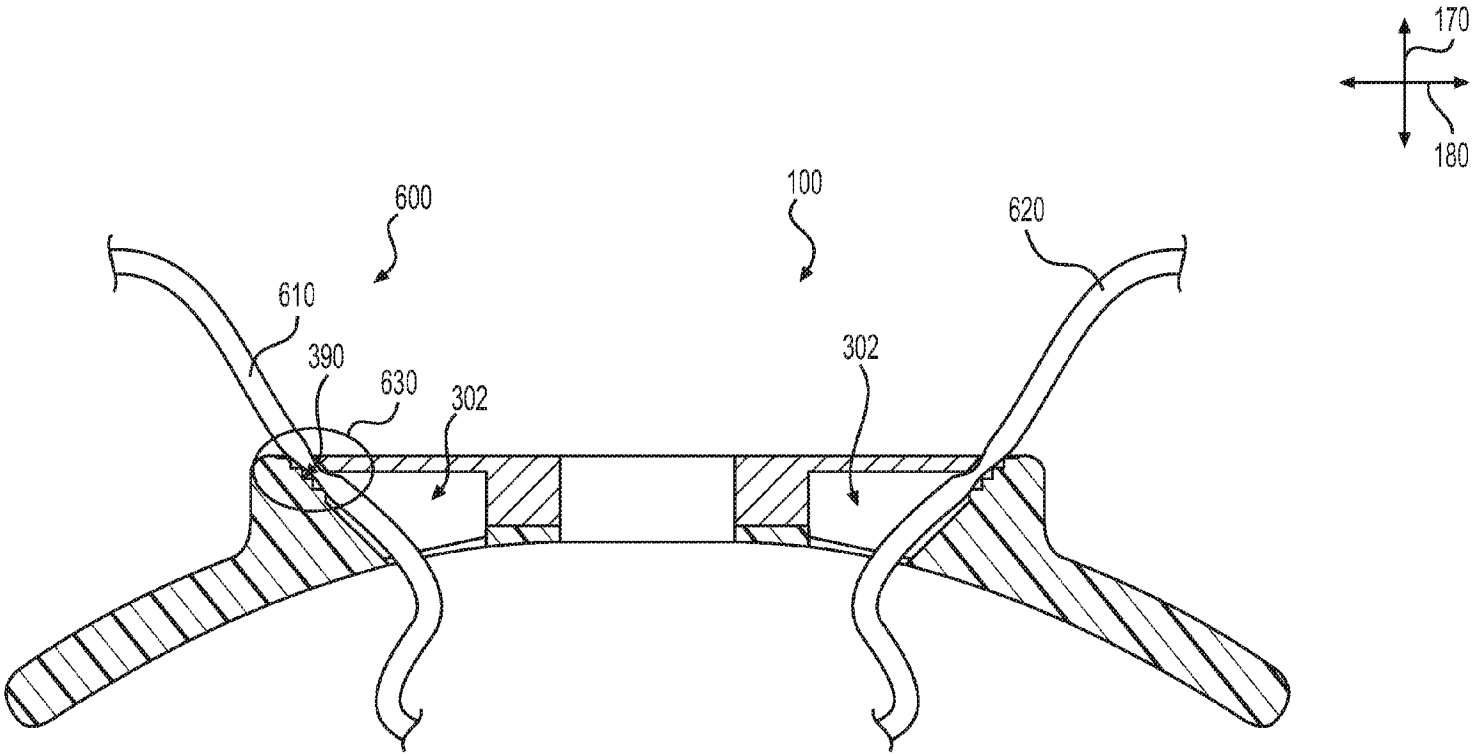
FIG. 6 is a cross-sectional schematic view of an embodiment of a fastening mechanism with a lacing element.

In the embodiment depicted in FIG. 6, a cross-sectional view of fastening mechanism 100 is shown with a second lacing element 600. Second lacing element 600 is larger in diameter or girth relative to first lacing element 500 shown in FIG. 5. In some cases, second lacing element 600 can be thicker than first lacing element 500. Second lacing element 600 includes a first portion 610 extending through first channel 302, and a second portion 620 extending through second channel 304. It can be seen that first portion 610 has a second secured region 630, where second secured region 630 refers to the segment(s) of first portion 610 that is held or gripped by portions associated with first channel 302. In other embodiments, second secured region 630 is associated with the portion of the lacing element that is contacted or compressed by one or more of plurality of ridges 390. In FIG. 6, due to the girth of second lacing element 600, distal opening 310 has a fourth size in the secured or resting (first) state. The fourth size in FIG. 6 is larger than the third size represented in FIG. 5. Thus, in some embodiments, the size of the mouth or distal opening 310 can vary to accommodate a wider range of differently sized or shaped lacing elements.

This description of features, systems, and components is not intended to be exhaustive, and in other embodiments, the article may include other features, systems and/or components. Moreover, in other embodiments, some of these features, systems, and/or components could be optional. As an example, some embodiments may not include reinforcing elements or a sidewall of a sole structure. Furthermore, fastening mechanism 100 and embodiments disclosed herein may be utilized with or refer to any of the techniques, concepts, features, elements, methods, and/or components from Spanks et al., U.S. Patent Publication No. US 2017-0202310 A1, published Jul. 20, 2017, (previously U.S. patent application Ser. No. 15/001,299, filed Jan. 20, 2016), titled "Article of Footwear With A Tensioning System,", the disclosure of which is incorporated herein by reference in its entirety.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A fastening mechanism for an article of footwear, comprising:

a rigid element attached to an elongated member, the elongated member including a central aperture that is sized and dimensioned to receive the rigid element, the elongated member being substantially more flexible than the rigid element;

a first channel formed between the rigid element and the elongated member, and a second channel formed between the rigid element and the elongated member;

the first channel being configured to receive at least a portion of a lacing element;

the first channel including a sloped sidewall comprising an upper sloped sidewall portion and a lower sloped sidewall portion that is continuous with the upper sloped sidewall portion;

the first channel including a proximal channel portion with a proximal opening, the proximal channel portion comprising the lower sloped sidewall portion and an inner wall portion disposed opposite of the lower sloped sidewall portion, wherein the lower sloped sidewall portion is sloped relative to the inner wall portion;

the first channel including a distal channel portion with a distal opening, the distal channel portion comprising the upper sloped sidewall portion and an outer edge portion disposed opposite to the upper sloped sidewall portion, wherein the upper sloped sidewall portion extends between the lower sloped sidewall portion and the distal opening; and the sloped sidewall including a plurality of ridges, wherein each of the plurality of ridges comprise a first edge joined to a second edge, the first edge being orthogonal to the second edge;

the elongated member including a first state and a second state;

wherein the first edge is substantially parallel with a vertical axis in the first state;

wherein the first edge is oriented diagonally with respect to the vertical axis in the second state.

2. The fastening mechanism of claim 1, wherein a first cross-sectional area of the proximal opening is larger than a second cross-sectional area of the distal opening.

3. The fastening mechanism of claim 1, the rigid element further comprising a rigid sidewall, the rigid sidewall being disposed between the inner wall portion and the sloped sidewall, and the rigid sidewall being disposed opposite the proximal opening.

4. The fastening mechanism of claim 1, wherein each of the plurality of ridges has a tip portion, and wherein each tip portion includes a substantially right-angled corner.

5. The fastening mechanism of claim 1, wherein the plurality of ridges are nearer to the distal opening than they are to the proximal opening.

6. The fastening mechanism of claim 1, wherein the proximal opening is substantially rectangular.

7. The fastening mechanism of claim 3, wherein the rigid sidewall is oriented in a direction substantially aligned with a longitudinal axis.

8. The fastening mechanism of claim 1, wherein the first channel extends through the fastening mechanism between a proximal surface of the fastening mechanism and a distal surface of the fastening mechanism.

9. The fastening mechanism of claim 8, wherein the elongated member is curved such that the proximal surface of the fastening mechanism is substantially concave.

10. The fastening mechanism of claim 8, wherein the rigid element includes a rigid sidewall disposed opposite the proximal opening and wherein the rigid element includes the outer edge portion.

11. The fastening mechanism of claim 8, wherein the sloped sidewall comprises a surface of the elongated member.

12. The fastening mechanism of claim 11, wherein the first channel further comprises a first sidewall and a second sidewall, the first sidewall and the second sidewall comprising surfaces of the elongated member.

13. The fastening mechanism of claim 12, wherein the first sidewall and the second sidewall are substantially similar in size and shape.

14. The fastening mechanism of claim 12, wherein the proximal portion of the first channel has a substantially trapezoidal prism shape.

15. The fastening mechanism of claim 1, wherein the second channel is substantially symmetric with respect to the first channel.

16. A fastening mechanism for an article of footwear, comprising:

a thickness extending between a distal surface and a proximal surface of the fastening mechanism;

a rigid element and an elongated member, the rigid element being located in a central aperture of the elongated member;

a first channel formed between the rigid element and the elongated member and including a sloped sidewall;

the first channel extending through the thickness of the fastening mechanism between a distal opening formed in the distal surface and a proximal opening formed in the proximal surface, the first channel being configured to receive at least a portion of a lacing element;

the sloped sidewall including a plurality of ridges, wherein each of the plurality of ridges comprise a first edge joined to a second edge, the first edge being orthogonal to the second edge;

the elongated member including a first state and a second state;

wherein the first edge is substantially parallel with a vertical axis in the first state;

wherein the first edge is oriented diagonally with respect to the vertical axis in the second state; and wherein the fastening mechanism is configured to transition from the first state to the second state when a compressive force is applied to a first member end of the elongated member and a second member end of the elongated member.

17. The fastening mechanism of claim 16, wherein the geometry of the rigid element in the first state is substantially similar to the geometry of the rigid element in the second state.

18. The fastening mechanism of claim 16, wherein the outer edge portion is substantially aligned with the vertical axis and wherein the sloped sidewall is nonparallel with the outer edge portion.

19. The fastening mechanism of claim 16, wherein the first state is configured to secure the lacing element, and wherein the second state is configured to release the lacing element.

20. The fastening mechanism of claim 16, wherein a first cross-sectional area of the distal opening in the first state is smaller than a second cross-sectional area of the distal opening in the second state.

* * * * *